United States Patent [19]

Hoffman et al.

[11] Patent Number: 4,848,577

[45] Date of Patent: Jul. 18, 1989

[54] BLISTER PACK AND FRAME ASSEMBLY

[75] Inventors: Leo Hoffman, North Bellmore, N.Y.; Robert T. Auer, E. Stroudsburg, Pa.; Richard L. Keats, Sands Point, N.Y.; Stephan Roeser, Dumont, N.J.; Lawrence Stern, Yardley, Pa.

[73] Assignee: Buddy L. Corporation, New York, N.Y.

[21] Appl. No.: 246,631

[22] Filed: Sep. 20, 1988

[51] Int. Cl.[4] ..... B65D 73/32

[52] U.S. Cl. ..... 206/467; 206/471; 206/45.34

[58] Field of Search ..... 206/461–471, 206/484, 491, 45.31, 45.33, 45.34

[56] References Cited

U.S. PATENT DOCUMENTS

| | | | |
|---|---|---|---|
| 2,576,708 | 11/1951 | Williamson | 206/45.34 X |
| 2,993,587 | 7/1961 | Stone et al. | 206/45.34 X |
| 2,996,236 | 8/1961 | Barr | 206/45.31 |
| 3,159,274 | 12/1984 | Burt | 206/45.33 |
| 3,403,838 | 10/1968 | Van Dyke | 206/45.33 X |
| 3,416,656 | 12/1968 | Addiego | 206/461 |
| 3,446,413 | 5/1969 | Sherrill et al. | 206/45.33 X |
| 3,481,453 | 12/1969 | Shreve, III et al. | 206/45.33 X |
| 3,874,500 | 4/1975 | Nicholl | 206/45.33 X |
| 4,485,922 | 12/1984 | Desmond et al. | 206/485 |
| 4,732,273 | 3/1988 | De Marco | 206/45.34 X |

FOREIGN PATENT DOCUMENTS

| | | | |
|---|---|---|---|
| 1524555 | 4/1968 | France | 206/45.34 |

*Primary Examiner*—William Price
*Attorney, Agent, or Firm*—Michael Ebert

[57] ABSTRACT

A double-faced blister pack and frame assembly for packaging and displaying an article of merchandise. The article is sandwiched between a pair of superposed, transparent plastic sheets whose central regions are molded to generally conform to the opposite faces of the article, the four superposed margins of the sheets each defining a flange. The frame is formed of a cardboard strip that is so die-cut and folded as to create a chain of four interhinged branches each having a triangular truss cross section whose base chord is the outer wall of the frame and whose central strut is constituted by parallel walls extending from the apex of the triangle to the base chord to form a narrow slot. Socketed in the slot of each branch is the corresponding flange of the pack whereby the pack is supported by the frame, and the opposite faces of the article which lie within the frame are both exposed to a prospective purchaser who is able to fully examine the article without having to break open the package to do so.

8 Claims, 4 Drawing Sheets

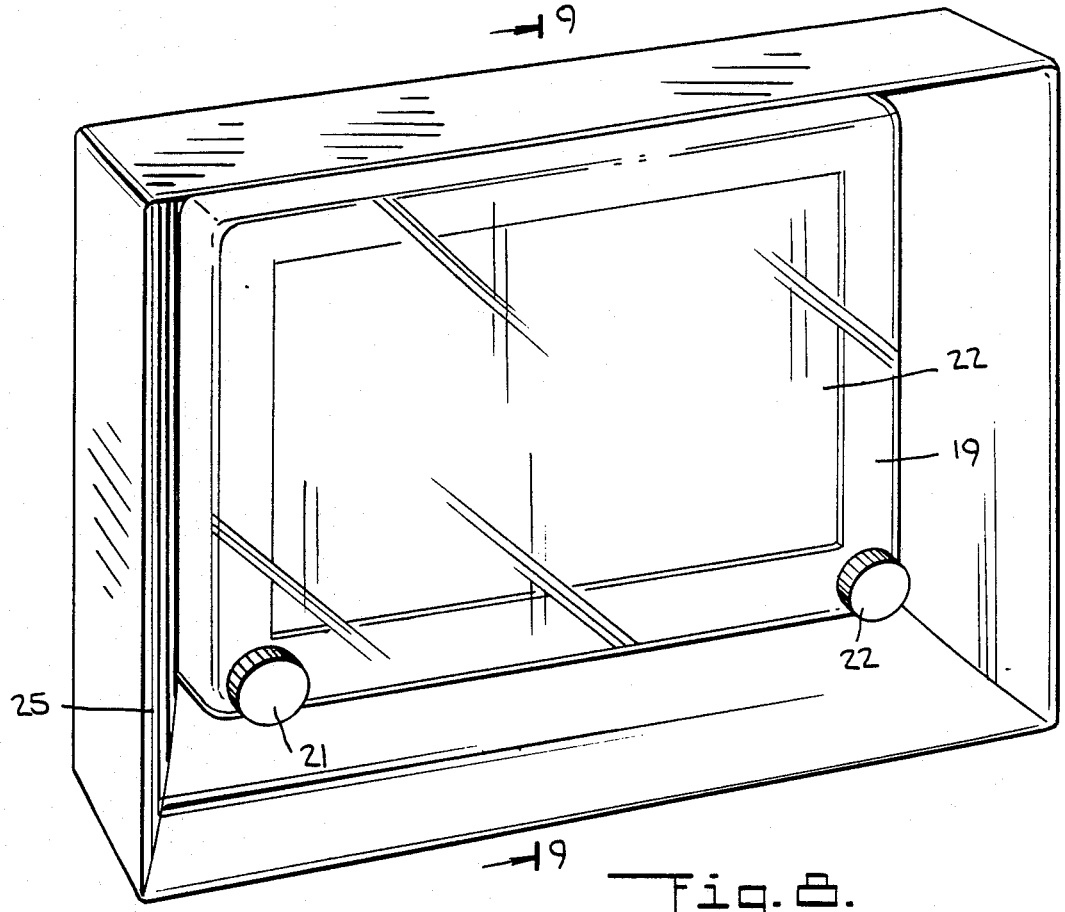
Fig. 8.
Fig. 9.
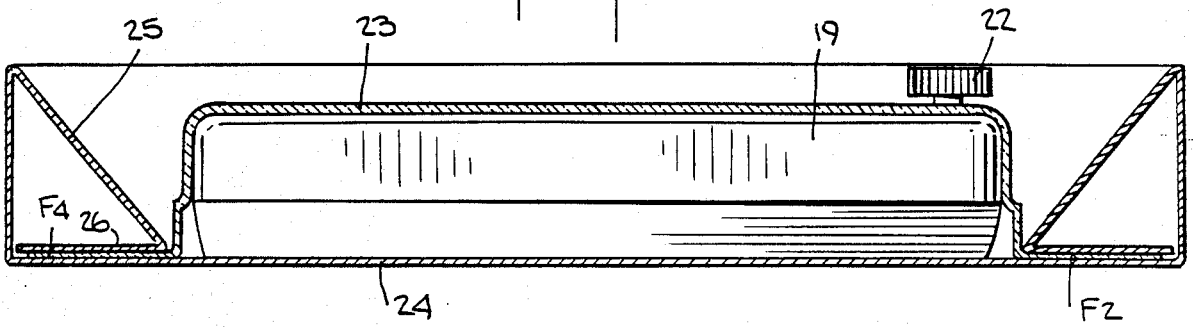

BLISTER PACK AND FRAME ASSEMBLY

BACKGROUND OF INVENTION

1. Field of Invention

This invention relates generally to packages for articles of merchandise, and more particularly to a blister pack and frame assembly for packaging and displaying the article so as to expose all aspects thereof to a prospective purchaser without having to break open the package.

2. Status of Prior Art

Modern merchandising imposes contradictory requirements on packaging. In order to ship and store an article of merchandise, the package therefor must be relatively light weight, yet strong enough to withstand rough handling. Thus, in the case of toys, it is conventional to package a toy vehicle in a sealed, corrugated board carton having opaque walls, the toy being seated in a cavity molded in a foam plastic cushioning insert or a die cut corrugated or chipboard insert.

But when the packaged toy is put on the shelf of a retail toy store, then the requirement is that the nature of the article being offered for sale must be evident to the prospective purchaser so as to promote its sale. Since the toy is concealed in an opaque box, the only impression gained by the viewer of its contents is from representations or pictures of the toy on the face and sides of the box.

A two-dimensional photograph is incapable of doing justice to the exact nature of the packaged toy, and may therefore fail to encourage its purchase. It is for this reason that many toys are packaged in open front cartons, as disclosed, for example, in the Hanazato U.S. Pat. No. 4,574,946, thereby giving the prospect direct access to the toy so that he is able to more or less see what is being offered.

There are several practical drawbacks to open front cartons for toys and other merchandise. First, to prevent the article from falling out of the carton when it is being handled or shipped, and also to prevent unauthorized removal of the article, it is necessary to provide locking means to securely retain the article in the carton without, however, blocking its display. But even if the article is adequately secured in an open front carton, only one side or face is visible, and a prospective customer has no idea of what the other side of the toy looks like. Hence, in many instances he may not gain an adequate impression of the article.

Moreover, a toy in an open-front carton is not shielded from dust and other sources of product contamination arising from exposure and handling. When this carton is placed on a store shelf for a prolonged period and is repeatedly handled by customers seeking to decide whether or not to buy the toy, it may lose its pristine character and become unsaleable as soiled merchandise.

To overcome the drawbacks of open front cartons, it is known to package toys and other merchandise in a blister pack formed by a sheet of clear plastic molded to conform generally to the front face of the article and marginally bonded to a cardboard backing. The advantage of a blister pack is that it seals the article against contamination, yet displays its dominant face. But a blister pack has a contoured formation largely determined by the article housed therein, it is not box-like and lacks the structural strength and handling characteristics of box-like packages. And because of its contoured shape, it does not lend itself to stacking.

Moreover, blister packs are difficult to open, for the clear plastic sheet forming the blister is marginally sealed to a cardboard backing sheet. The blister cannot be peeled off the backing sheet, but the sheet itself must be torn open to obtain access to the entrapped article. It is for this reason that in some blister packs, the backing sheet is perforated to make it easier to tear open.

But whether the package is in the form of an open-front carton or a blister pack, the viewer cannot see the rear face of the merchandise, and is therefore deprived of a full three-dimensional view. This full view is not available to the prospective purchaser until he removes the article from its package, and he cannot do this until he first purchases the article and obtains possession thereof. This puts the prospective purchaser in a dilemma; for without being able to see the entire article, he doesn't know whether he wants to buy it; yet in order to see the entire article, he must first buy it.

SUMMARY OF INVENTION

In view of the foregoing, the main object of this invention is to provide a blister pack and frame assembly for packaging and displaying an article of merchandise, the assembly being capable of withstanding rigorous handling, yet displaying the article packaged.

More specifically, an object of this invention is to provide an assembly of the above type in which all faces of the article packaged are exposed so as to afford a three-dimensional view revealing all aspects of the article.

A significant advantage of an assembly in accordance with the invention is that it not only exposes the article, but the geometry of the assembly is such that it lends itself to stacking.

Also an object of the invention is to provide a lightweight assembly of the above type whose cardboard frame is composed of hollow branches each having a high-strength truss formation.

Yet another object of the invention is to provide an assembly of the above type in which the frame may readily be separated from the blister pack, thereby making it possible to open the pack to obtain access to the article without the need to tear open the frame or the pack.

Briefly stated, these objects are attained in a double-faced blister pack and frame assembly for packaging and displaying an article of merchandise. The article is sandwiched between a pair of superposed, transparent plastic sheets whose central regions are molded to generally conform to the opposite faces of the article, the four superposed margins of the sheets each defining a flange.

The frame is formed of a cardboard strip that is so die-cut and folded as to create a chain of four interhinged branches each having a triangular truss cross section whose base chord is the outer wall of the frame and whose central strut is constituted by parallel walls extending from the apex of the triangle to the base chord to form a narrow slot. Socketed in the slot of each branch is the corresponding flange of the pack whereby the pack is supported by the frame, and the opposite faces of the article which lie within the frame are exposed to a prospective purchaser who is able to fully examine the article without having to break open the package to do so.

BRIEF DESCRIPTION OF DRAWINGS

For a better understanding of the invention as well as other objects and further features thereof, reference is made to the following detailed description to be read in conjunction with the accompanying drawings, wherein:

FIG. 3 shows the pair of superposed plastic sheets which form the blister pack;

FIG. 8 is a perspective view of a single faced blister pack and frame assembly in accordance with the invention; and FIG. 9 is a transverse section taken through the assembly shown in FIG. 8.

DESCRIPTION OF INVENTION

Figure 1:
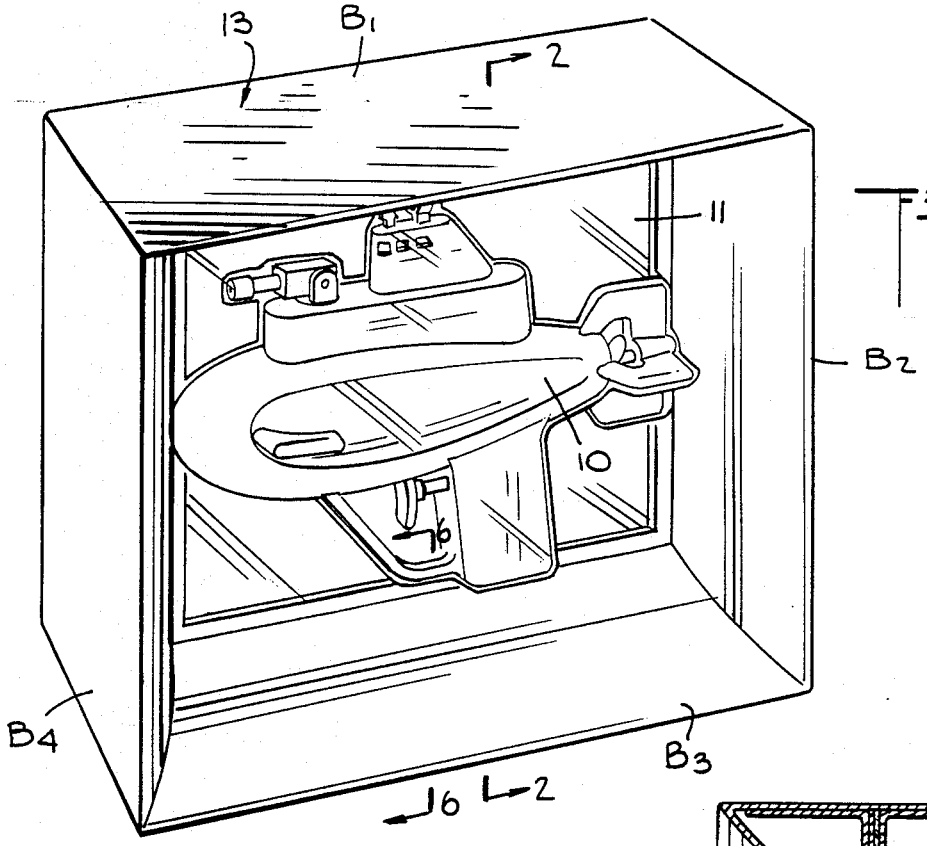
FIG. 1 is a perspective view of one preferred embodiment of a double-faced blister pack and frame assembly in accordance with the invention for housing a toy.
Figure 2:
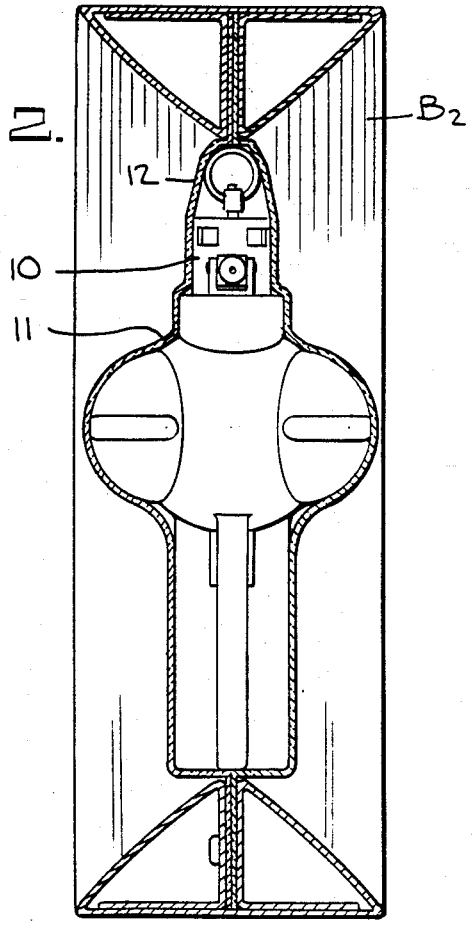
FIG. 2 is a transverse section taken in the plane indicated by line 2—2 in FIG. 1.
Figure 4:
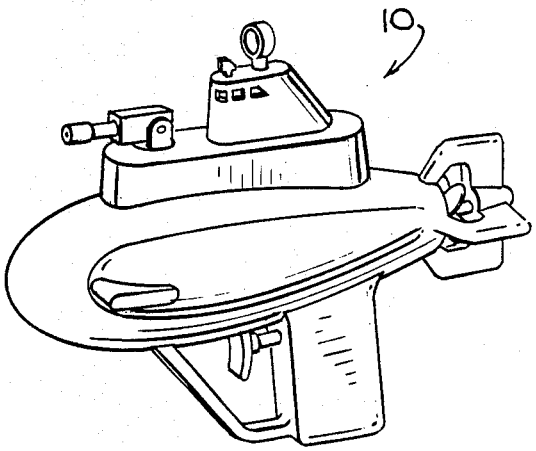
FIG. 4 separately shows the toy packaged in the assembly.

First Embodiment:

Referring now to FIGS. 1 to 3, a double-faced blister pack frame assembly in accordance with the invention is shown for housing a toy water gun 10. As best seen in FIG. 4, this gun has the format of a miniature submarine from which water is ejected when the trigger is pulled by the player. This toy is by way of example only; for in practice, the assembly may be dimensioned to house other forms of toys, such as a locomotive or flashlight, or other articles of merchandise whose three-dimensional exposure permits a prospective customer to fully view the article without having to break open its package.

Article 10 is sandwiched between a pair of superposed transparent rectangular sheets 11 and 12, which, as best seen in FIG. 3, is formed of synthetic, plastic, flexible film material such as polyvinyl or polypropylene. The central regions of these sheets are molded to conform generally to the opposing faces of the article, thereby defining a contoured pocket to entrap the article so that it is not, loose in the pack. The superposed margins of the sheets define marginal flanges $F_1$ to $F_4$.

Figure 6:
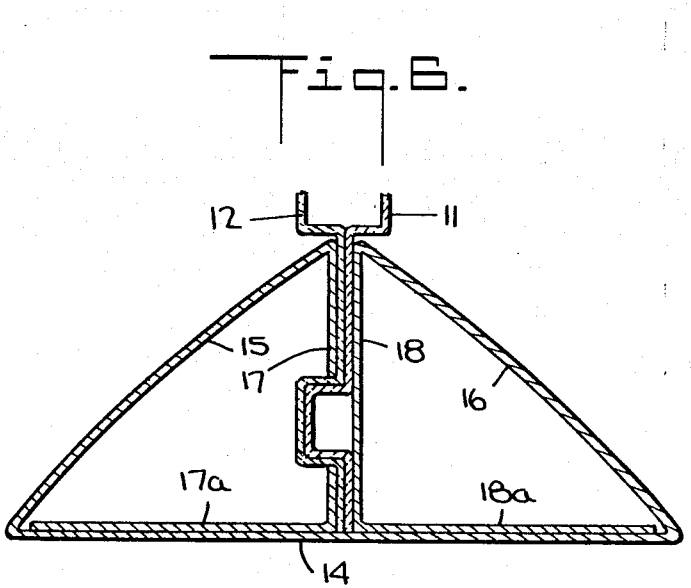
FIG. 6 is a cross section of one branch of the frame having the marginal flange of the pack socketed therein.

The blister pack, so formed, is socketed within a cardboard frame, generally designated by reference numeral 13, formed by interhinged branches $B_1$ to $B_4$. As shown by the cross-sectional view in FIG. 6, each branch is in a triangular truss formation constituted by a base chord 14 which defines the outer wall of the frame, a pair of inclined webs 15 and 16 which define the sloping inner walls of the frame on opposite faces thereof, the webs extending from the ends of the base chord to the peak or apex of the triangle, and a central strut formed by a pair of parallel walls 17 and 18 extending from the apex to the base chord. The parallel walls 17 and 18 define a narrow slot S and are provided with flaps forming outstretched feet 17*a* and 18*a* which lie against base chord 14.

As is known in structural engineering, a triangular truss is inherently rigid and resists deformation or deflection when stressed. Even though the frame is formed of cardboard, its resistance to deformation is far greater than a frame of the same material having a rectangular or other non-truss formations.

Figure 5:
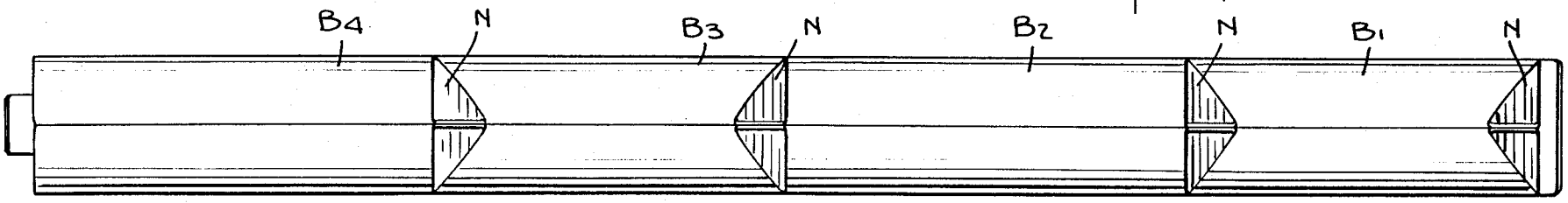
FIG. 5 is an unfolded view of the four interhinged branches of the frame.
Figure 7:
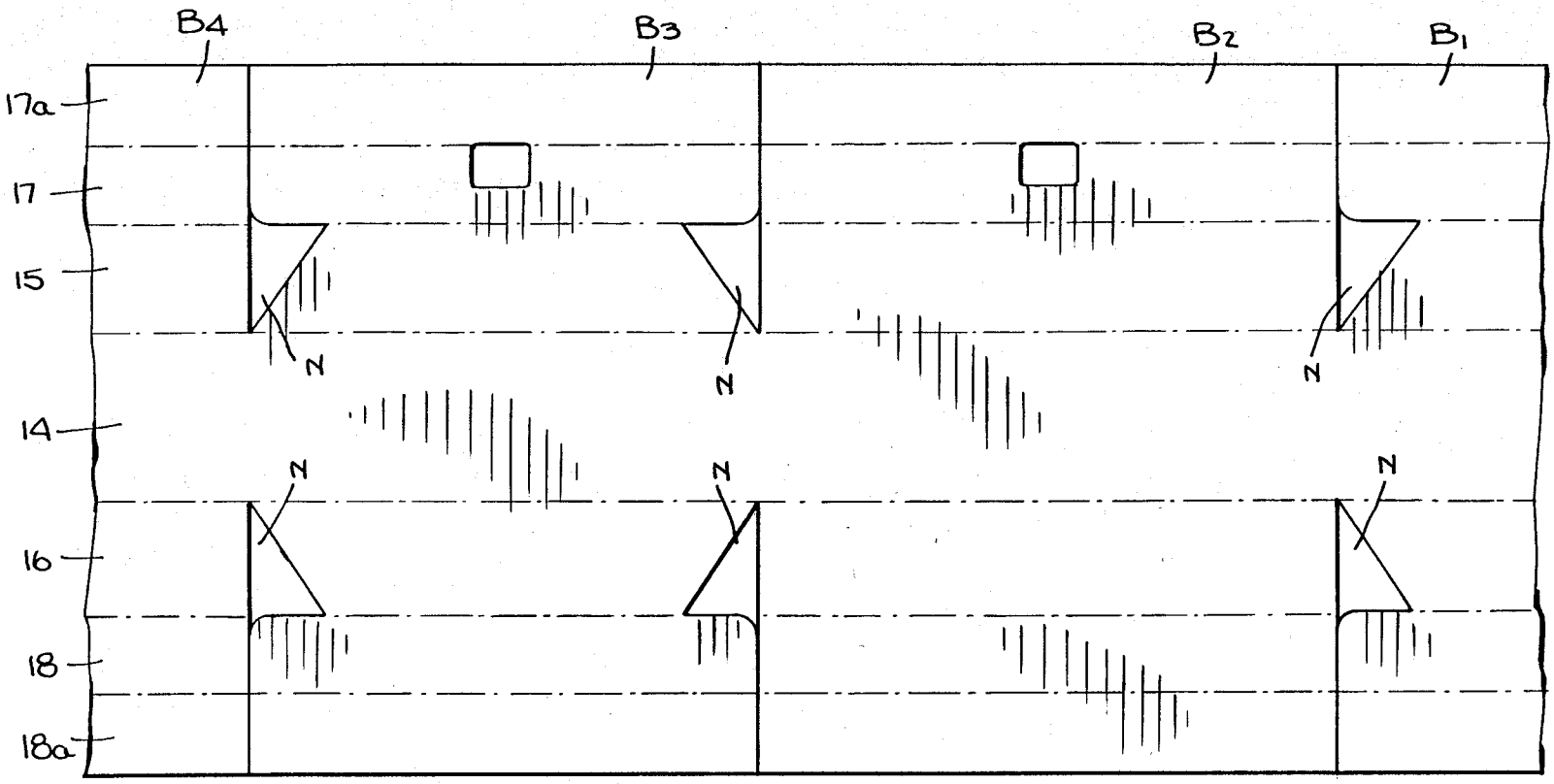

The marginal flanges $F_1$ to $F_4$ are inserted in the slots S of the corresponding frame branches $B_1$ to $B_4$. As shown in FIG. 5, Branches $B_1$ and $B_3$ are provided at either end with triangular notches N to accommodate the ends of branches $B_2$ and $B_4$ when these branches are folded in to define the four right angle corners of the frame. Hence, when assembling the frame about the blister pack, the marginal flanges $F_1$ to $F_4$ are inserted in the slots S as the interhinged branches in the chain thereof are folded about the pack. It is then only necessary to complete the frame by adhering a holding tape at the corner formed by branches $B_1$ and $B_4$ to prevent disassembly of the chain. To open the package, it is only necessary to cut the tape and then unfold the branches, thereby releasing the pack from the frame and making it possible to separate sheets 11 and 12 in order to remove the article pocketed therein.

Figure 7:
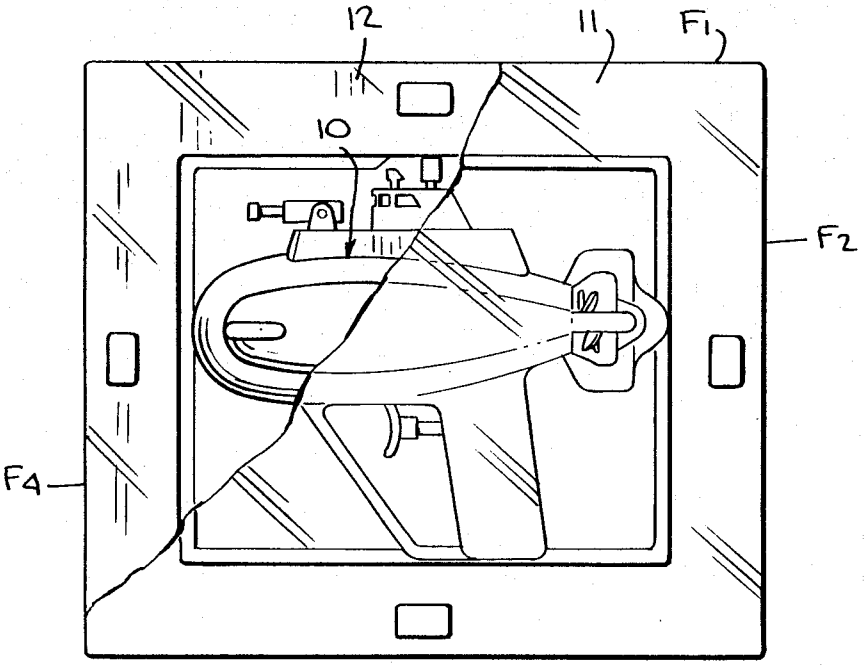
FIG. 7 illustrates the cardboard blank from which the frame is formed.

The interhinged branches $B_1$ to $B_4$ are created, as shown in FIG. 7, from a single blank of cardboard which is webs 15 and 16 and walls 17 and 18 which form slot S, as well as the triangular notches N.

Thus, a prospective purchaser is able to see the packaged toy in three dimensions, for no portion of the toy is concealed from view by the blister pack and the surrounding frame. An instruction booklet and other printed material may be included in the blister pack in separate pockets molded therein, so that when the blister pack is opened one then has access to this material. And the outer and inner walls of the frame may be printed with graphics appropriate to the housed article. It is to be noted that the article housed in the assembly is somewhat smaller in length, width and thickness than the frame, so no part of the article bulges beyond the rectangular frame. This makes it possible to stack the assemblies for shipping or storage, or on a store shelf.

In practice, however, one may make a blister pack which bulges out on one side and is therefore convex and which has a complementary concave form on the other side, so that the packages may be stacked one above the other. Also, instead of a blister pack one may use an injection-molded clear section.

Second Embodiment:

In some instances, the nature of the article to be housed in the blister pack and frame assembly is such that only a front face view is necessary in that the rear face of the article is simply a back or flat base, and a view thereof is unimportant to an appreciation of the nature of the article.

Hence in the single-faced assembly shown in FIGS. 8 and 9, the housed article in this instance is a box-like toy tracing device 19 having a screen 20 and a pair of knobs 21 and 22, making it possible for a user operating the knobs to trace lines on the screen in the X, Y and Z directions and thereby create graphic forms, letters or any other linear shapes. The back of this tracing device is flat and there is no need to view it.

In this single-faced assembly, the blister pack is formed by a single sheet 23 of transparent film material whose central region is molded to conform to the box-like shape of the toy tracing device whose front face is exposed by the sheet. The marginal flanges $F_1$ to $F_4$ of sheet 23 rests on the flat back 24 of a frame formed from a blank of cardboard which is die cut and scored to form corner gussets and inclined inner walls 25, having foldable flaps 26 which overlie the flanges of the blister sheet to lock the blister in the frame, as shown in FIG. 9.

To obtain access to the housed toy, one has only to fold out the branches of the frame so as to release the blister sheet from the frame, which is then raised to free the toy.

While there have been shown and described preferred embodiments of a blister pack and frame assembly in accordance with the invention, it will be appreciated that many changes and modifications may be made therein without, however, departing from the essential spirit thereof. Thus, the frame may be made of corrugated board rather than cardboard and be in hexagonal or octagonal form rather than rectangular, in which case the corners are not right angles.

We claim:

1. A blister pack and frame assembly for housing an article of merchandise comprising:

(A) a blister pack constituted by a pair of superposed rectangular sheets of transparent, plastic film material between which is sandwiched the article, the central regions of the sheets being molded to define a pocket conforming generally to the front and rear faces of the article, the sheets having superposed margins defining flanges on all four sides of the pack;

(B) a double-faced rectangular frame formed by four branches each having an intermediate longitudinal slot therein to accommodate the corresponding flange of the pack, whereby the pack is supported by the frame and both faces of the article which lies within the frame are exposed, each branch having a cross section defining a triangular truss having inclined webs, a base chord and a central strut, the base wall of the truss forming the outer wall of the trouble-faced frame, the inclined webs defining sloping inner walls of the double-faces frame and the central strut having said slot formed therein.

2. An assembly as set forth in claim 1, wherein said frame is formed of cardboard.

3. An assembly as set forth in claim 1, wherein said article is a toy whose length, width and thickness dimensions are smaller than those of the frame.

4. An assembly as set forth in claim 1, wherein said four frame branches are interhinged to form a chain which is foldable to form right angle corners, further including removable means to hold together the end branches of the chain.

5. An assembly as set forth in claim 1, wherein said centrals strut is formed by a pair of parallel walls which extend between the apex of the triangle and the base chord thereof to define said slot.

6. An assembly as set forth in claim 5, wherein said parallel walls are provided with outstretched feet which engage the base chord.

7. A blister and frame assembly for housing an article or merchandise comprising a blister pack including a multi-sided sheet of transparent, plastic material whose central region is molded to conform generally to the front face of the article to form a pocket therefor, and having a marginal flange on all sides thereof, and a frame supporting the sheet formed by a like number of interhinged branched forming a chain, each socketing a corresponding flange, each branch having a vertical outer wall and an inclined inner wall having a folded-in flap at right angles to the vertical wall overlying the corresponding flanges, whereby to release the article from the assembly, one has only to fold out the branches of the chain.

8. An assembly as set forth in claim 7, wherein said frame is formed of cardboard and is provided with a back wall on which the flanges rest.

* * * * *

UNITED STATES PATENT AND TRADEMARK OFFICE

CERTIFICATE OF CORRECTION

PATENT NO. : 4,848,577

DATED : July 18, 1989

INVENTOR(S) : Leo Hoffman et al

It is certified that error appears in the above-identified patent and that said Letters Patent is hereby corrected as shown below:

Column 5, line 37, "trouble-faced" should read --double-faced --.

Column 6, line 21, "or" should read --of--.

Signed and Sealed this

Twenty-fourth Day of April, 1990

*Attest:*

HARRY F. MANBECK, JR.

*Attesting Officer*

*Commissioner of Patents and Trademarks*